United States Patent [19]

Reutter

[11] Patent Number: 4,511,056

[45] Date of Patent: Apr. 16, 1985

[54] CLOSURE ASSEMBLY PARTICULARLY FOR A RADIATOR FILLER TUBE OF A MOTOR VEHICLE

[75] Inventor: Heinrich Reutter, Waiblingen, Fed. Rep. of Germany

[73] Assignee: Reutter Metallwarenfabrik GmbH, Waiblingen, Fed. Rep. of Germany

[21] Appl. No.: 449,612

[22] Filed: Dec. 14, 1982

[30] Foreign Application Priority Data

Dec. 18, 1981 [DE] Fed. Rep. of Germany ..... 3150231

[51] Int. Cl.[3] ..... B65D 51/16

[52] U.S. Cl. ..... 220/204; 220/367; 220/DIG. 32

[58] Field of Search ..... 220/204, 203, 367, DIG. 32

[56] References Cited

U.S. PATENT DOCUMENTS 1,898,055 2/1933 Jarvis ..... 220/DIG. 32 X
3,974,936 8/1976 Gerdes ..... 220/DIG. 32 X
4,079,855 3/1978 Avrea ..... 220/367 X
4,337,873 7/1982 Johnson ..... 220/204

*Primary Examiner*—Steven M. Pollard
*Attorney, Agent, or Firm*—Toren, McGeady and Stanger

[57] ABSTRACT

A closure assembly particularly useful as a radiator cap for the radiator filler tube of a motor vehicle including bayonet connectors for removably fastening the assembly to a filler tube is formed with a vacuum valve and an excess pressure or relief valve formed on an inner cap assembly of the closure assembly, with the inner cap assembly being formed with a pair of telescopically slidable parts and with a compression spring which is preferably constructed as a cup spring in order to press one of the telescopic parts relative to the other to effect sealing engagement with the seat of the filler tube, the force of the cup spring being greater than the closing force of a load spring which is provided for the excess pressure or relief valve.

8 Claims, 7 Drawing Figures

CLOSURE ASSEMBLY PARTICULARLY FOR A RADIATOR FILLER TUBE OF A MOTOR VEHICLE

The present invention relates generally to cap-type closure assemblies and more particularly to the structure of a radiator cap useful as a closure for the radiator filler tube of a motor vehicle.

Closure assemblies of the type to which the present invention relates are generally formed with bayonet lugs which elastically mount the radiator cap on the filler tube of a motor vehicle, the filler tube being particularly a radiator type of filler tube which is itself formed with complementary bayonet lugs for engaging the lugs of the cap. The cap assembly is structured in a manner whereby the inner end thereof lies in sealing engagement with a seat of the filler tube.

In a known closure assembly of the type to which the present invention relates, there is provided a valve plate which is held so as to be slidable against the resistance of a strong compression spring and which tilts within limits at a central shaft of the closure. During the occurrence of excess pressure within the radiator filler tube, the valve plate is somewhat lifted from the seat of the filler tube and the excess pressure is relieved by means of the now opened valve of the cap. Due to a number of factors, not the least of which is manufacturing tolerances, it is not possible to rely on exact maintenance of the maximum pressure in the filler tube or in the radiator with utilization of this prior art arrangement. It should be noted that such cap or closure assemblies are usually mass-produced articles within which extremely narrow tolerances cannot be maintained.

The present invention is therefore directed toward provision of a closure assembly of the type mentioned above wherein pressure in the filler tube and also of course in the apparatus of which the filler tube is a part, for example an automotive radiator, may be maintained at a desired level with greater accuracy than has been previously possible with prior art devices.

SUMMARY OF THE INVENTION

Briefly, the present invention may be described as a closure assembly particularly useful as a radiator cap for the radiator filler tube of a motor vehicle comprising connecting means for removably fastening the closure assembly upon a member to be sealed and valve means operatively mounted in said closure assembly, said valve means including an excess pressure or relief valve and a vacuum valve. The closure assembly is formed with an inner end thereof which forms a valve closing element or plate which rests in sealed engagement against the seat of the filler tube. The invention is particularly characterized in that the excess pressure valve as well as the vacuum valve are located particularly at the valve plate or valve closing element which extends into the interior of the filler tube or they may be formed at a tubular valve closing element which is formed as part of the closure assembly.

By using a separate excess pressure valve and a separate vacuum valve, it is possible to balance out the excess pressure in the filler tube by means of the excess pressure or relief valve and any negative pressure which may occur will be relieved by means of the vacuum valve. The valves are constructed in such a way that they may be manufactured with an accuracy which is greater than can be otherwise ensured for the filler tube. It should also be particularly considered that due to the separate structure of the valves in the closure, the closure may be adjusted and checked in the factory without the use of a filler tube. Up until the present time, testing of such closure assemblies was only possible by placing the assembly on a filler tube which on the one hand caused the testing operations to increase in difficulty and expense and which on the other hand did not guaranty accuracy because the filler tube used for testing generally might not correspond with the filler tube onto which the closure would be placed when in actual use.

Filler tubes and closures usually originate from different manufacturers. If a closure in accordance with the prior art is pressed by means of a spring in a sealed manner onto the seat of the filler tube, then this spring and the load spring of the valve closing element of the excess pressure valve must be adjusted in such a manner that the excess pressure or relief valve will open before the valve plate of the closure assembly lifts from the seat of the filler tube.

The excess pressure valve and the vacuum valve of the present invention may be of simple construction so that manufacturing costs are maintained low and assembly costs can also be kept low for example by enabling the assembly to be performed completely automatically.

In a preferred embodiment of the invention, the seats of the excess pressure valve and of the vacuum valve are formed at a valve plate. They may be located in an advantageous manner at opposite surfaces of the valve plate. The valve seats may be defined by an annular extension or lip which surrounds the flow opening of the valve means either directly or at a small distance. In this case, it is advantageous to manufacture the valve plate, or the part which has the valve plate, of plastic.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
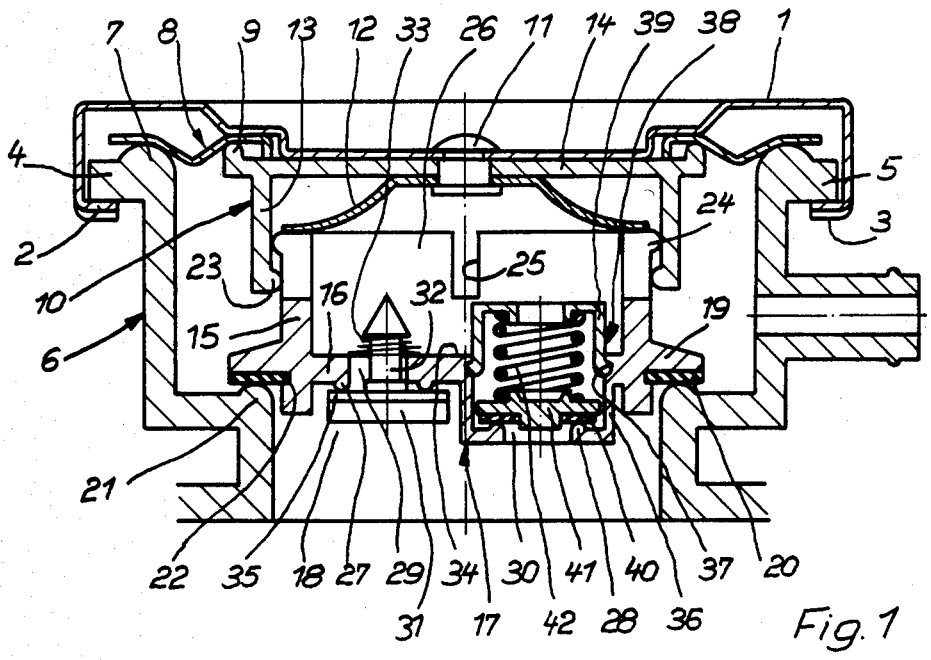
FIG. 1 is a sectional view showing a first embodiment of the invention mounted upon a filler tube.

Referring now to the drawings, and particularly to FIG. 1, there is shown a first embodiment of a closure assembly in accordance with the invention, with the closure assembly shown mounted in the closing position upon a filler tube 6 which may be a radiator filler tube for a motor vehicle.

The closure assembly of the invention is formed with a grip member 1 which is constructed in a generally known manner and which may be made of sheet steel. The grip member 1 is formed with bayonet lugs 2 and 3 which are offset from each other by 180° and which in the closed position shown in FIG. 1 engage in complementary bayonet lugs 4 and 5 formed on the filler tube 6. The closure assembly of the invention is arranged to be engaged on the filler tube 6 with a firm fit which is secure against rotation and this is achieved on the one hand by the bayonet means 2–5 but also by a spring tension which is created as a result of a spring diaphragm 8 which rests with its elastic rim on a filler tube opening member 7.

The closure assembly is formed with an inner cap assembly 10 which, in the embodiment of FIG. 1, includes an inner tubular part 15 and an outer tubular part 13 which are telescopically slidable relative to each other in a manner to be more fully described hereinafter.

The spring diaphragm 8 is clamped between an upstanding rim 9 formed on the outer tubular part 13 of the inner cap assembly 10 and the grip member 1, with the grip member 1 being fixedly connected with the outer tubular part 13 by means of a rivet 11. The rivet operates simultaneously also to mount in assembled condition a compression spring 12.

As previously indicated, the inner cap assembly 10 is formed to include the two tubular parts 13 and 15 which are telescopically slidable relative to one another, with the outer tubular part 13 being formed at the end thereof associated with the grip member 1 with a plate 14 which is clamped between the grip member 1 and the compression spring 12. The upwardly projecting rim 9 is arranged to serve for pressing the spring diaphragm 8 against the grip member 1.

The inner tubular part 15 is formed at the end thereof facing inwardly of the filler tube 6 with a plate 16 onto which there are operatively mounted an excess pressure valve 17 and a vacuum valve 18. An outwardly projecting rim 19 of the inner tubular part 15 has attached thereto a flat sealing ring 20 which is adapted to be firmly pressed against a valve seat 21 of the filler tube 6 when the closure assembly is engaged on the filler tube in the manner shown in FIG. 1. A groove 22 formed in the inner tubular part 15 serves to hold in assembled position the sealing ring 20.

The tubular parts 13 and 15 which are telescopically movable relative to each other are formed with stop means to limit the extent of relative movement therebetween. These stop means comprise an inner lip 23 formed on the tubular part 13 and an outer lip 24 formed on the tubular part 15. The lips 23 and 24 will engage against each other to limit the maximum movement of the members relative to each other. When the closure assembly of the invention is removed from the filler tube 6, the compression spring 12 will press the outer lip 24 against the inner lip 23. It will be evident that when the closure assembly is placed in position on the filler tube 6, the engagement of the sealing ring 20 against the valve seat 21 will urge the inner tubular part 15 against the force of the compression spring 12 thereby separating the lips 23 and 24.

In order to enable assembly of the members 13 and 15 of the inner cap assembly 10, the inner tubular part 15 is formed with four longitudinal slots 25 which are distributed uniformly about the periphery thereof. The slots 25 thereby form the tubular part 15 with four resilient tongues 26 which are located between the longitudinal slots 25. As a result, the tongues 26 are capable of some resilient deformation in order to accommodate assembly of the tubular part 15 into the tubular part 13.

As indicated in FIG. 1, the inner tubular part 15 has mounted at a plate 16 thereof the excess pressure valve 17 and the vacuum valve 18 which are installed at a location adjacent the interior of the filler tube 6. The member 15 is formed with a valve seat 27 for the vacuum valve 18 and also with a valve seat 28 for the excess pressure valve 17. As indicated in FIG. 1, the valve seats 27 and 28 are formed in the plate 16 so that they face in opposite directions. It will be noted that both the valve seats 27 and 28 are formed as integral elevations and they operate to limit, respectively, an opening 29 in the valve 18 for inflowing medium, and an opening 30 in the valve 17 for outflowing medium. The valve 18 includes a valve closure member 31 which consists of a circular plate having formed thereon a stem 32 with a free end which is thickened and of a conical configuration. The conical end of the stem 32 forms a shoulder against which a pressure spring 33 engages, the spring 33 being formed as a conical compression spring having at its upper end a smaller diameter than the base of the conical end of the stem 32.

The lower end of the spring 33 having a larger diameter lies on a top side 34 of the plate member 16. A sealing ring 35 is provided on the closure member 31 for engagement against the seat 27.

The seat 28 of the excess pressure valve 17 is formed at the bottom of a cupped recess 36 defined by the plate member 16. In the area of the rim of this cupped recess there is an annular groove which forms a first half 37 of a snap closure 38. The valve 17 is formed with a cupped centrally perforated cover 39 having a free end at which there is formed a lip member which forms a second half of the snap closure 38. The excess pressure valve 17 includes a valve plate 41 which carries a sealing ring 40, the valve plate 41 being supported in an overhung position and being pressed downwardly by means of a helical compression spring 42 so that the valve plate 41 will act against the valve seat 28. Small tubular attachments at the valve plate 41 and at the cover 39 operate to effect centering of the compression spring 42.

Figure 2:
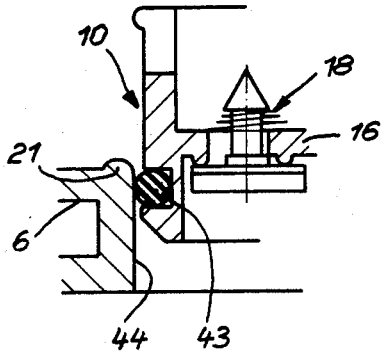
FIG. 2 is a detailed sectional view showing a part of an assembly in accordance with the present invention embodying a variation of the structure shown in FIG. 1.

FIG. 2 shows a variation of the construction shown in FIG. 1 wherein the axial seal which is provided between the flat sealing ring 20 and the valve seat 21 is replaced by a radial type of seal. In the modification of FIG. 2, the inner cap assembly 10, which is also provided with a valve plate 16, is formed with a radial sealing ring 43 which engages against an inner circumferential surface 44 of the filler tube 6. The surface 44 therefore essentially forms a valve seat against which the radial sealing ring 43 engages and in the embodiment according to FIG. 2, it is not necessary that the inner cap assembly be made of two telescoping parts such as the parts 13 and 15. However, the cap assembly 10 may still be constructed in two parts to facilitate manufacture and assembly and the two parts may be connected together by means of a snap or catch closure without requiring that they be telescopically movable relative to each other.

With regard to the embodiment shown in FIG. 1, in the position before the closure assembly is secured, the telescopic arrangement of the parts 13 and 15 makes possible a decrease in pressure in the radiator filler tube and, if necessary, in an equalizing container in that the sealing ring 20 will lift from the valve seat 21.

Furthermore, in the embodiment of FIG. 1, the tubular shape of the cap assembly 10 facilitates the assembly of the excess pressure valve 17 and of the vacuum valve 18 and protects these valves to the extent that they are located in the tube interior. At the same time, it is possible to assemble at the outside of the tube the seal, such as the sealing ring 20, for making contact with the valve seat 21 of the radiator filler tube. This may be accomplished simply by forming a groove such as the groove 22 at the outer periphery of the inner cap assembly 10.

If necessary, an outer collar or rim such as the outwardly projecting rim 19 may be provided for supporting the seal and the outer collar for support of the seal can be connected at one groove side if the seal consists of a flat sealing ring in a known manner. At the end of the tube which faces away from the valve plate, the fastening collar, fastening plate or the like can be installed, preferably as a formed-on part.

Of course, it will also be appreciated that in the embodiment of FIG. 1 there is provided an inner cap assembly consisting of two telescopically slidable tubular parts wherein the tubular part which is associated with the grip member 1 carries a fastening plate wherein between the two tubular parts a compression spring is connected and stop members are formed to limit the length of extension of the telescopic parts. The compression spring, i.e., the spring 12, provides the pressure of the tubular part which has the valve plate to the valve seat of the filler tubes. The stop members must be placed at both tubular parts in such a way that the telescopic arrangement is not completely extended when the seal is pressed on.

The invention is developed so that in order to form the stop members, the outer tubular part 13 has an inner elevation or the like and the inner tubular part 15 has an outer elevation or the like, wherein at least one of the tubular parts has longitudinal slots in the region of its elevation to form resilient tongues 26. However, the longitudinal slots need not only operate to provide the resilient tongues at the respective tubular end but they may also operate to form openings when the excess pressure valve 17 or the vacuum valve 18 is opened, unless other flow openings are provided in the tubular wall. At the same time the stop members, i.e., the stops 23 and 24, also form connecting members for a catch or snap connection of the two tubular parts. Although in FIG. 1, four longitudinal slots 25 are provided, the length and the number of the longitudinal slots will depend upon the individual requirements and the material used.

In accordance with a further aspect of the invention, it is provided that the compression spring be constructed as a sort of a cupped spring and that its outer rim be supported at the inner end of the inner tubular part 15 which is formed with the plate member 16. The cup spring 12 is characterized by being low in cost and involving small space requirements as well as requiring simple assembly procedures. It is of special advantage that the diameter of the circle of the cup spring may correspond approximately to the inner diameter of the essentially annular disc-shaped spring diaphragm so that the cup spring can be manufactured from the punched out inner part of the spring diaphragm. Since usually punching waste during manufacturing of the spring diaphragm is not used, there is in this embodiment a saving in the costs for the material of the cup spring.

In addition, it is quite advantageous if the grip member 1, the spring diaphragm 8 as well as the inner cap assembly 10 are connected by means of a rivet 11 or the like whereby rapid automatic assembly is possible.

In accordance with the aspect of the invention depicted in FIG. 2, the free tubular end of the inner cap assembly 10 is formed to carry the radial sealing ring 43 which may be an O-ring with the valve seat of the filler tube being the inner wall 44 of the filler tube itself. As previously indicated, in this case, telescopically movable parts for the inner cap assembly may be omitted because now the axial pressure of the sealing ring is replaced by radial pressure and tolerances with respect to length or changes in length due to changed temperatures may equalize automatically without disadvantageous effects on the seal. On the other hand, this presupposes a relatively high accuracy with regard to size of the inside cross-section of the filler tube in the area of the seal and a surface which corresponds to the sealing ring. By omitting the aforementioned longitudinal slots at one of the two telescopic parts, i.e., the inner tubular part 15, it becomes necessary to provide in the embodiment of FIG. 2 for a radial passage possibility at the tubular wall unless another flow path is provided..

Figure 3:
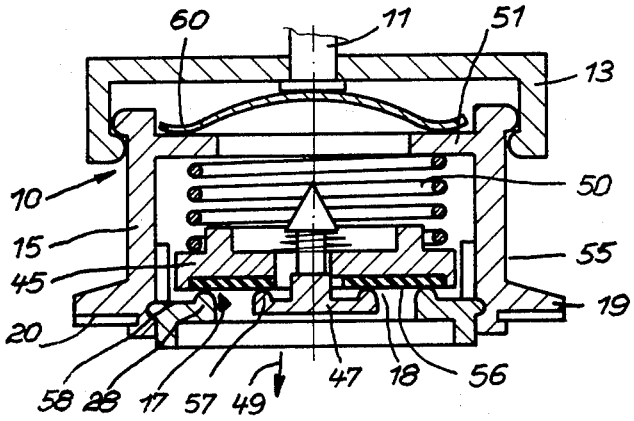
FIG. 3 is a sectional view showing part of a third embodiment of the invention.
Figure 4:
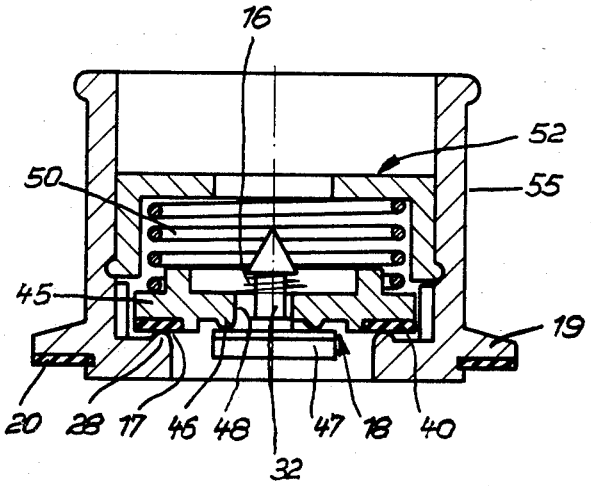
FIGS. 4–6 are sectional views showing three additional variations of the invention in accordance with FIG. 3.

In FIGS. 3–6 there is depicted an embodiment wherein the valve seat for the vacuum valve 18 is defined by a vacuum closure element or vacuum plate of the excess pressure valve 17. For example, as seen in FIG. 4, the excess pressure valve 17 is comprised of a closure member or valve plate 45. The plate 45 is formed with a lip 46 which operates as the valve seat of the vacuum valve 18 and against which the closure member of the vacuum valve 18 abuts. However, the valve seat of the vacuum valve 18 does not necessarily need to be formed in the same manner as is shown in FIG. 4. The valve closure member 47 of the vacuum valve 18 extends with its stem 32 through but not necessarily round bore 48 of the valve closure member 45 of the excess pressure valve 17 in each of the embodiments of FIGS. 4–6. Otherwise, the vacuum valve 18 is constructed essentially in the same manner as shown in FIG. 1. When in this embodiment the excess pressure valve is opened, then this leads simultaneously to a lifting of the complete vacuum valve. Conversely, the closing element 47 of the vacuum valve 18 moves in the direction of an arrow 49 shown in FIG. 3 into the interior of the filler tube without moving the closure element 45 of the excess pressure valve 17 when the vacuum pressure exceeds a set value.

Figure 6:
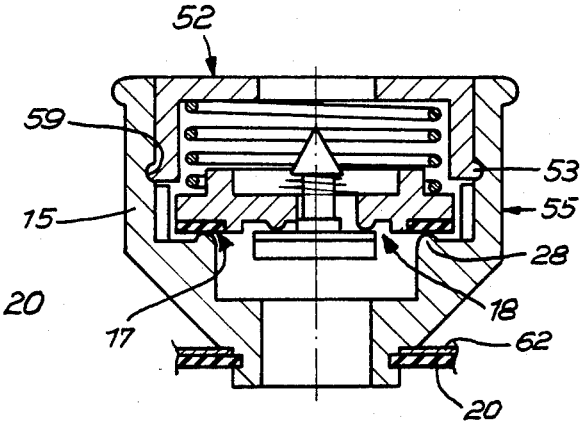

A load spring 50 of the excess pressure valve 17 is advantageously constructed as a compression spring and it is held at one end at a centering attachment of the closure element 45 and in the embodiment according to FIGS. 3, 4, and 6, it is supported at an inwardly projecting collar 51 which is advantageously formed integrally with the inner tubular part 15.

In FIGS. 4 and 6, it relates to the centrally perforated bottom of a cup-shaped structural part 52 which carries at its free cup rim an outer lip 53 which is secured in an annular groove 54 of the inner tubular part 15. In FIG. 6, the bottom finishes flush with the upper end of the inner tubular part while in FIG. 4 the bottom lies somewhat lower. The variations of FIGS. 3, 4, and 6 have in common that the unit depicted in completely preassembled and may be tested for perfect functioning and to provide exact responsiveness in the excess pressure valve 17 and the vacuum valve 18 before the unit is connected with the grip member.

In FIG. 3, the closure element 45 of the excess pressure valve 17 carries a wide sealing ring 56 at whose inner area the closing element 47 of the vacuum valve 18 engages. Therefore, the inner area of the sealing ring 56 forms the valve seat for the vacuum valve 18. The closure element 47 in the embodiment of FIG. 3 may therefore be formed devoid of a sealing ring, such as the sealing ring which is provided on the closure member 47 in the embodiment of FIG. 4, and it need only be provided with a lip or pressure elevation 57 which engages against the ring 56.

Figure 5:
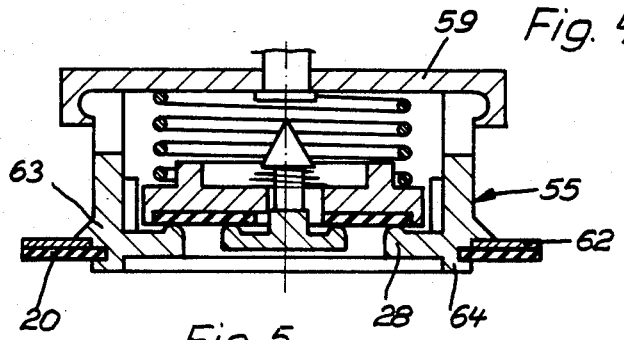

In each of the embodiments of FIGS. 4–6 there is shown a seat 28 for the excess pressure valve 17 which can be constructed either as an integrally formed inner collar of the tubular valve closure element 55, particularly manufactured integrally therewith, or as part of a ring 58 (see FIG. 3) which is inserted at the inside of the tubular valve closing element 55 or is preferably sprung in. Moreover, the tubular valve closure element 55 need not necessarily form the inner tubular part 15 of a telescopic arrangement and it can also be attached or connected in a snapped manner directly at a retaining collar 59 which then in turn is riveted to the grip member 1, in a manner analagous to that involving the outer tubular part 13 of FIG. 1. However, such a construction presupposes a special structure in the area of the sealing ring 20, which will be discussed in greater detail hereinafter.

In FIG. 3, a load spring 60 is formed which differs in its construction from the spring 12 in FIG. 1. The spring 60 is constructed as a clip spring having a longitudinal center axis which extends in the drawing plane. On the right and left side there is always one circular segment-shaped support member which is attached and which results because the support members and the load springs are punched out of a disc. The two support members prevent lateral yielding of the clip spring from the center of the closure.

Figure 7:
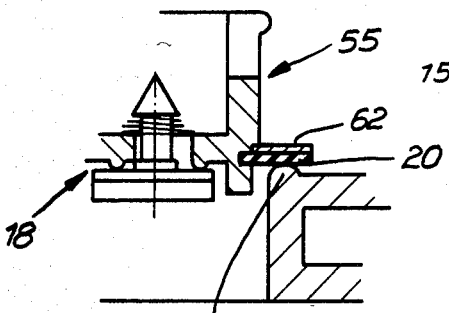
FIG. 7 is a sectional view showing in greater detail a further embodiment of the invention related to the embodiment shown in FIG. 2.

In the embodiments of FIGS. 5–7, the closure assembly of the invention is arranged so that telescopically slidable parts are omitted and the engagement of the sealing ring 20 against the valve seat 21 of the filler tube 6 is achieved by operation of a resilient ring 62.

It will be noted in this regard that in the embodiment of FIGS. 1, 3, and 4, the sealing ring 20 is supported for contact at the valve seat 21 of the filler tube 6 at an outwardly projecting rim 19 of the inner cap assembly 10. It will be further noted that the load spring 12, 60 effects the pressure of the sealing ring against the valve seat when the closure is assembled. However, in FIGS. 5–7 the telescopically movable arrangement of the parts 13 and 15 is omitted and the resilient ring 62 operates to press the sealing ring 20 against the seat 21 of the filler tube 6.

Advantageously, the ring 62 is pushed into the free tubular end of the tubular valve closing element 55 until it comes to rest against a shoulder or at an outer collar 63 of the inner cap assembly 10 and is held in this position by the sealing ring 20 which is sprung into a groove 64 of the inner cap assembly 10 or of the tubular valve closing element 55. This construction is particularly simple and economical and it can easily be replaced by other structures, for example, in that the two annular elements are held by means of an additional ring, for instance a Seeger ring or the like. While in FIGS. 5–7, the inner cap assembly 10 or the tubular valve closing element 55 has a cylindrical, essentially tubular shape, the parts 10 or 55, in the variation shown in FIG. 6, may have a conical construction at the end thereof which extends into the interior of the filler tube during use. This reduces the inner diameter of the resilient ring 62 as well as of the sealing ring 20 and the width of these rings may be selected to be larger at the same filler tube width. In this manner, there may be achieved a higher elasticity of the resilient ring 62 with a resilient characteristic which is more favorable for the requirements than in a narrow ring. In addition, the parts 20 and 62 which are shown broken off in FIG. 6, may be adapted in their outer diameter to the different inside filler tube widths or valve seat diameters (valve seat 21).

This is particularly important in automobile construction where these closures are mainly used in connection with the filler tube of a radiator and recently also in those of a cooler-equalizing container. These filler tubes may differ from manufacturer to manufacturer. Merely by exchanging the sealing ring 20 and the resilient ring 62, it is possible to easily adapt the closures without requiring additional changes.

In the embodiment shown in FIGS. 1, 2, and 7, the excess pressure valve 17 and the vacuum valve 18 are arranged side-by-side while in the other embodiments there is shown a vacuum valve which is located essentially in the interior of the excess pressure valve. It is easily possible to exchange certain features of the various embodiments and of course it will be obvious that many modifications within the context of the present invention may exist. For example, the load spring 12 which is constructed as a cup spring in FIG. 1 may be replaced with the load spring 60 of FIG. 3. Additionally, in the embodiment according to FIG. 2, it is appropriate to provide an excess pressure valve and a vacuum valve in accordance with the construction shown in FIG. 4.

Thus, it will be seen that the additional embodiments of the invention, particularly those described in FIGS. 4–6, may operate to provide the seat of the excess pressure valve to be located particularly in the center of the valve plate or tubular valve closing element, and the seat of the vacuum valve at the closing element of the excess pressure valve. This concentric arrangement of the excess pressure valve and the vacuum valve will produce a relatively large closing element for the excess pressure valve and therefore the plate becomes by necessity an annular or tubular valve closing element. Therefore, the sealing ring or the sealing surface of the closing element of the closure which interacts with the seat of the radiator filler nozzle will extend concentrically around the seat of the excess pressure valve. Instead of the concentric arrangement of three sealing surfaces or valve seats, it is possible to select an eccentric arrangement. However, this is not usually as advantageous due to manufacturing reasons and it is only provided if special reasons exist. Since the seat of the excess pressure valve and consequently also of the closing element will be larger in the aforementioned embodiment than in an arrangement where the vacuum valve and the excess pressure valve are located side-by-side, at the same height of lift of the closing element of the excess pressure valve a significantly enlarged exit flow cross-section results, or vice versa, and with a reduced lift one can achieve the same exit flow cross-section as in the side-by-side arrangement. In addition, further advantages result.

In a development of the invention which provides that the closure element of the excess pressure valve be formed with a sealing ring at whose inner area the closure element of the vacuum valve is pressed on, a single sealing ring is therefore sufficient for the excess pressure valve and the vacuum valve and consequently one can conserve and avoid use of a separate sealing ring at the closing element of the vacuum valve. Accordingly, an assembly work step is avoided.

In the embodiment wherein the spindle 32 of the closure element 47 of the vacuum valve 18 penetrates the annular closing element 45 of the excess pressure valve 17 which is located in the inner cap assembly 10, and wherein a closing spring 16 of the vacuum valve 18 is connected between the steplike, thickened spindle end of the stem and the excess pressure valve closing element 45, the seat of the excess pressure valve is advantageously constructed as a ring which is held particularly in a snapping manner as the tubular valve closing element of the closure. This offers the possibility of forming at the end of the tubular valve closing element, located opposite the ring, an inwardly projecting collar for support of the load spring of the excess pressure valve and thus preassemble the closing element of the closure completely with the excess pressure valve as well as the vacuum valve and to test them separately from the closure. Particularly, the testing of such closure is an important, but also expensive, process which, for example in conventional closures, can only be performed in connection with a filler tube which makes the testing difficult and time-consuming and expensive because the closure must be attached these filler tubes exactly as it will be later provided during operation. Due to the preassembled units above-mentioned, testing can be performed completely automatically without the aid of a filler tube. Therefore, in a further advantageous development of the invention, the load spring 50 of the excess pressure valve 17 is supported at one side at an inwardly projecting collar 51 of the tubular valve closing element 55 or at a support ring 52 or the like which is inserted into the closing element, particularly attached in a locking manner, and is supported on the other side at the closing element 45 of the excess pressure valve 17. In the case of a support ring, this ring does not necessarily have to be flat, it may also have for example a tubular centering attachment and fastening attachment so that in its entirety a cup-shaped structure with a central bore and, for example, an outer elevation at the free end of the cup rim results.

Also, as previously indicated, instead of a cupped spring for the load spring of the invention, a clip spring may be used which is comparatively simple in manufacture and has a more favorable spring characteristic for the special case of application than a cup spring of known construction. The free clip ends are advantageously rounded off so that the clip spring over its entire width can extend closely up to the inner wall of the tubular valve closing element. In addition, this has the advantage that, when using circular section-shaped support members which are located at the left and right, the latter can be manufactured together with the clip spring from one disc. There may be applied four punch cuts at this disc, wherein always two are in extension from one another and each cut extends parallel to another. The two areas which are not cut between the punch lines which run in the extension from one another form the connection between the clip spring center piece and the support member which is located at the side thereof. The bending of the clip spring and punching of the disc in the described manner can be undertaken in one work step.

Another variation of the invention is characterized in that the sealing ring which can be pressed to the valve seat of the filler tube is supported by the resilient collar or ring of the inner cap assembly. Here, the inner cap assembly may be connected directly with the grip member and a relative displacement in the axial direction between these parts or a telescopic construction of the inner cap assembly may be avoided. The necessary resilient pressure on the sealing ring resting against the seat of the filler tube is achieved with the aid of the resilient collar or ring, i.e., the ring 62, at the inner part. It is particularly advantageous that the resilient ring be made of spring steel or the like and that it be held on one side by the sealing ring which springs into a groove of the inner cap assembly, as well as on the other side by an outer collar, step of the inner part or the like. The assembly takes place in that one simply pushes the resilient ring onto the respective end of the inner part and subsequently springs the sealing ring into its groove whereby both parts are securely held. The shoulder for support of the resilient ring which may be constructed for example by means of a spring ring or the like must be dimensioned in such a way that the resilient ring is on the one hand safely supported and on the other hand is not impeded during elastic upward bending. In addition, all parts must be dimensioned in such a way and must be made of such material that the necessary spring deflection and also the necessary contact pressure for the sealing ring at the filler tube are achieved.

In a further embodiment of the invention, the inner cap assembly in the area of the resilient ring or collar 62 may be formed with a reduced cross-section and it is particularly provided in accordance with the embodiment depicted in FIG. 6, that, for example, in the area of the resilient ring the inner cap assembly conically narrows toward the seat of the filler tube and that the diameter be reduced by approximately half. In this manner, one may achieve a greater width of the resilient ring so that its resilient characteristics may be better controlled. In addition, such a closure assembly may be easily adapted to various filler tube models.

In accordance with a further embodiment of the invention, the inner cap assembly is connected with the grip member while interconnecting a retaining cover wherein the retaining cover is held particularly in a locking manner at the inner cap assembly. The retaining cover again gives the possibility to test a unit which is comprised of the inner cap assembly, the excess pressure valve, and the vacuum valve separately from a filler tube and, if necessary, also assemble automatically. It can also fulfill another purpose in addition or as an alternate, for instance that of a separate construction of the inner part in the area of the valve seat or sealing ring. Particularly in the latter case, it is advantageous when the load spring of the excess pressure valve is supported at the retaining cover and can be stressed by springing out the retaining cover.

While specific embodiments of the invention have been shown and described in detail to illustrate the application of the inventive principles, it will be understood that the invention may be embodied otherwise without departing from such principles.

What is claimed is:

1. A closure assembly particularly useful as a radiator cap for a radiator filler tube of a motor vehicle comprising connecting means for removably fastening said closure assembly upon a member to be sealed, an inner cap assembly including means adapted to be brought in sealing engagement with said member to be sealed, and valve means operatively mounted in said inner cap assembly, said valve means comprising both a vacuum valve and an excess pressure valve, wherein said inner cap assembly comprises a plate member, wherein said vacuum valve and said excess pressure valve each include seat means and a valve member adapted to engage said seat means to open and close said valve, wherein said seat means of said excess pressure valve and of said vacuum valve are formed on said plate member of said inner cap member, and wherein said plate member includes a cupped portion defining a cupped recess, said cupped portion having said seat means of said excess pressure valve defined thereon with said seat means being arranged to define orifice means formed in said cupped recess, with a cover member being provided in snapped engagement with said inner cap assembly, said cupped portion and said cover member defining therebetween said excess pressure valve.

2. An assembly according to claim 1 wherein said cover member is cup-shaped and wherein a valve closure member of said excess pressure valve is supported in an overhung position between said cover member and said cupped portion of said plate member, said valve closure member having thereon a sealing ring and being pressed by means of a compression spring against said seat means, said compression spring being also supported by said cover member.

3. An assembly according to claim 1 wherein said vacuum valve includes a valve closure member which is supported on the side of said plate member facing the interior of said member to be sealed and is arranged to be in engagement with said seat means of said vacuum valve, said valve closure member of said vacuum valve comprising a valve spindle extending through a bore formed in said plate member with a compression spring being arranged in engagement between said plate member and said valve spindle, said valve spindle being formed with a thickened end defining a shoulder against which said spring is engaged with the other end of said spring being engaged against said plate member.

4. A closure assembly particularly useful as a radiator cap for a radiator filler tube of a motor vehicle comprising connecting means for removably fastening said closure assembly upon a member to be sealed, an inner cap assembly including means adapted to be brought in sealing engagement with said member to be sealed, and valve means operatively mounted in said inner cap assembly, said valve means comprising both a vacuum and an excess pressure valve, wherein said vacuum and said excess pressure valve are arranged concentrically relative to each other, wherein said vacuum valve and said excess pressure valve each include a valve closure member, wherein valve seat means for said excess pressure valve against which the valve closure member thereof engages is formed on said inner cap assembly and wherein valve seat means for said vacuum valve against which the valve closure member thereof engages is formed on the valve closure member for said excess pressure valve.

5. An assembly according to claim 4 wherein said valve closure member of said excess pressure valve includes a sealing ring defining the seat means for said vacuum valve and against which said valve closure member of said vacuum valve is pressed.

6. An assembly according to claim 4 wherein said valve closure member of said excess pressure valve is formed with a central opening, wherein said valve closure member of said vacuum valve is formed to include a spindle which extends through said opening in said valve closure member of said excess pressure valve, said spindle being formed with an enlarged end defining a shoulder, with a vacuum valve closure spring being provided in engagement between said shoulder and said valve closure member of said excess pressure valve to hold said valve closure member of said vacuum valve in closing engagement against said seat means formed on the valve closure member of said excess pressure valve.

7. An assembly according to claim 4 wherein said seat means of said excess pressure valve is formed at an annular member which is held in snapped engagement within said inner cap assembly.

8. An assembly according to claim 4 wherein said excess pressure valve includes an excess pressure load spring arranged in engagement between said inner cap assembly and said valve closure member of said excess pressure valve, said load spring being supported on one side thereof against an inwardly projecting collar formed in said inner cap assembly and on the other side thereof against said valve closure member of said excess pressure valve.

* * * * *